United States Patent [19]

Lebrecht

[11] Patent Number: 4,730,467

[45] Date of Patent: Mar. 15, 1988

[54] DOUBLE LOCKING COMBINATION LOCK

[75] Inventor: Horst Lebrecht, West Allis, Wis.

[73] Assignee: Master Lock Company, Milwaukee, Wis.

[21] Appl. No.: 938,188

[22] Filed: Feb. 5, 1986

Related U.S. Application Data

[63] Continuation of Ser. No. 703,360, Feb. 20, 1985, abandoned.

[51] Int. Cl.[4] ..... E05B 37/18

[52] U.S. Cl. ..... 70/25; 70/21; 70/38 A; 70/386

[58] Field of Search ..... 70/21, 25, 38 A, 284, 70/285, 386

[56] References Cited

U.S. PATENT DOCUMENTS

| | | | |
|---|---|---|---|
| 972,171 | 10/1910 | Dupont | 70/21 |
| 2,049,416 | 8/1936 | Aldeen | 70/284 X |
| 2,105,337 | 1/1938 | Soref et al. | 70/25 |
| 2,113,864 | 4/1938 | Soref et al. | 70/25 |
| 2,169,907 | 8/1939 | Soref et al. | 70/25 |
| 2,460,615 | 2/1949 | Andrew | 70/38 A X |
| 2,487,608 | 11/1949 | Soref et al. | 70/21 |
| 2,893,231 | 7/1959 | Soref et al. | 70/25 |
| 2,926,514 | 3/1960 | Junkunc | 70/21 |
| 2,931,203 | 4/1960 | Check | 70/285 X |
| 2,931,204 | 4/1960 | Check | 70/21 |
| 3,050,977 | 8/1962 | Foote et al. | 70/332 |
| 3,172,279 | 3/1965 | Patriquin | 70/38 A |
| 3,349,584 | 10/1967 | Russell et al. | 70/285 |
| 3,563,067 | 2/1971 | Foote | 70/25 |
| 3,855,824 | 12/1974 | Falk | 70/38 A |
| 4,055,972 | 11/1977 | Calegan | 70/25 |
| 4,158,952 | 6/1979 | Oliver et al. | 70/386 |
| 4,462,231 | 7/1984 | Zabel | 70/285 X |
| 4,658,606 | 4/1987 | Tseng | 70/38 A |

*Primary Examiner*—Robert L. Wolfe
*Assistant Examiner*—Suzanne L. Dino
*Attorney, Agent, or Firm*—Pennie & Edmonds

[57] ABSTRACT

A combination lock having both dial and key locking mechanisms and having long and short shackle legs which lock has a body containing a reciprocal cam plate for moving steel balls into and out of engagement with the shackles from lock to unlock position. An extending arm mounted on the cam plate engages the dial and key control means having a second extending arm is also engageable with the cam plate. The lock includes a spring upset arrangement.

5 Claims, 13 Drawing Figures

DOUBLE LOCKING COMBINATION LOCK

This is a continuation of application Ser. No. 703,360 filed Feb. 20, 1985 and now abandoned.

BACKGROUND OF THE INVENTION

Double locking combination locks have been proposed in which a combination padlock is also capable of being opened by key. The use of steel balls to engage and lock shackles of combination locks has been proposed in prior patents (see U.S. Pat. Nos. 2,931,204 and 3,855,824). Arrangements for upsetting a permutation wheel during closing and locking a padlock has been proposed.

None of the prior proposals or uses has provided a satisfactory lock with the strength, security and reliability of the present invention.

SUMMARY OF THE INVENTION

Broadly, the invention comprises a double locking combination lock in which a plurality of steel balls in a lock body cavity are controlled by movement of a cam plate associated with the housing to lock the shackle with two of the balls or with the unlocked shackle withdrawn from the body to hold the cam plate means in the open position.

The cam plate means is also controllable by a key lock with a rotatable cylinder which connects to the cam plate through a key cam and slide plate.

It is a feature of the invention that the shackle carries an upset spring to cause the discs to be upset when the shackle is moved downwardly into a locked position.

DESCRIPTION OF THE PREFERRED EMBODIMENT

Figure 1:
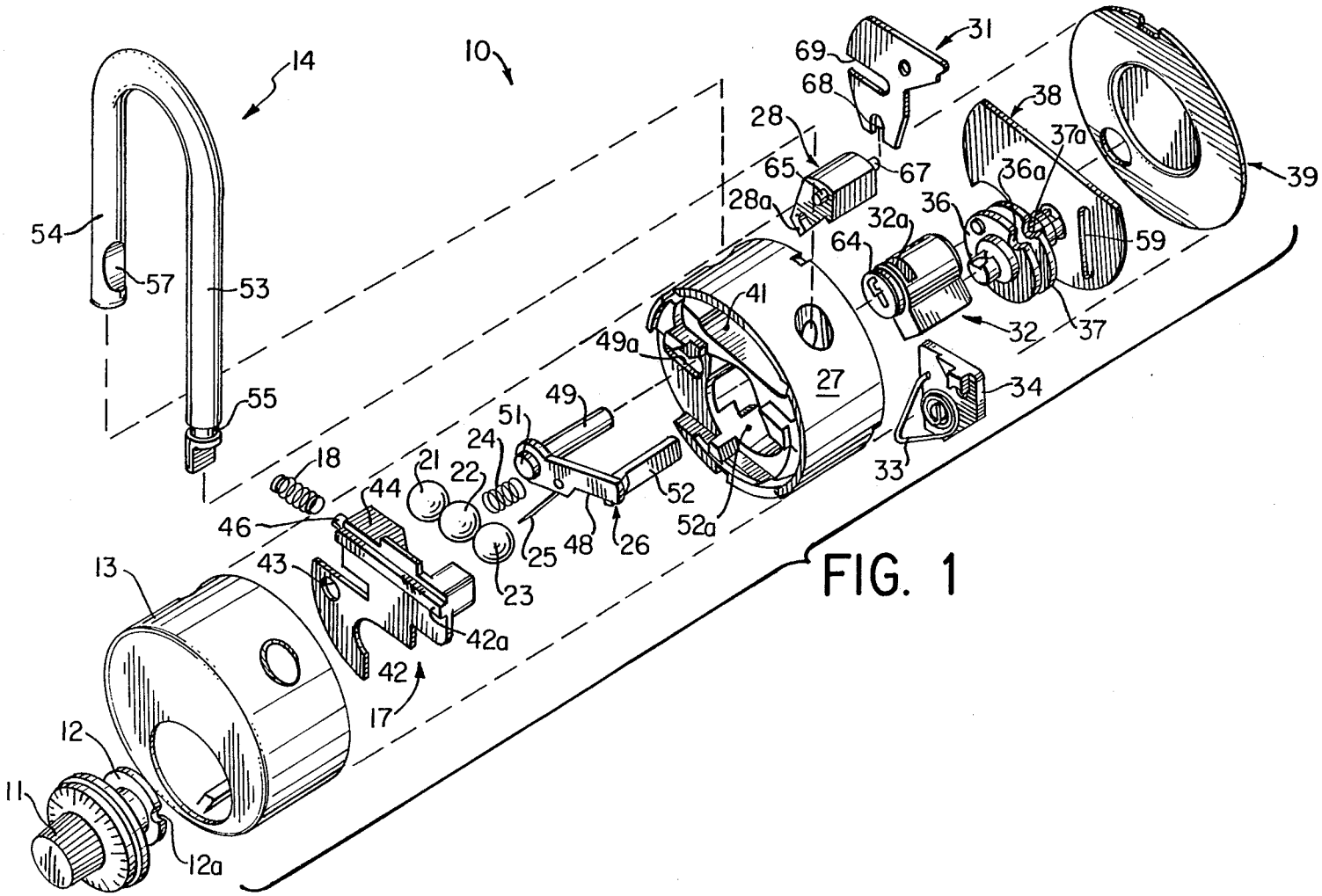
FIG. 1 is an exploded perspective view as seen from the front of the lock.
Figure 2:
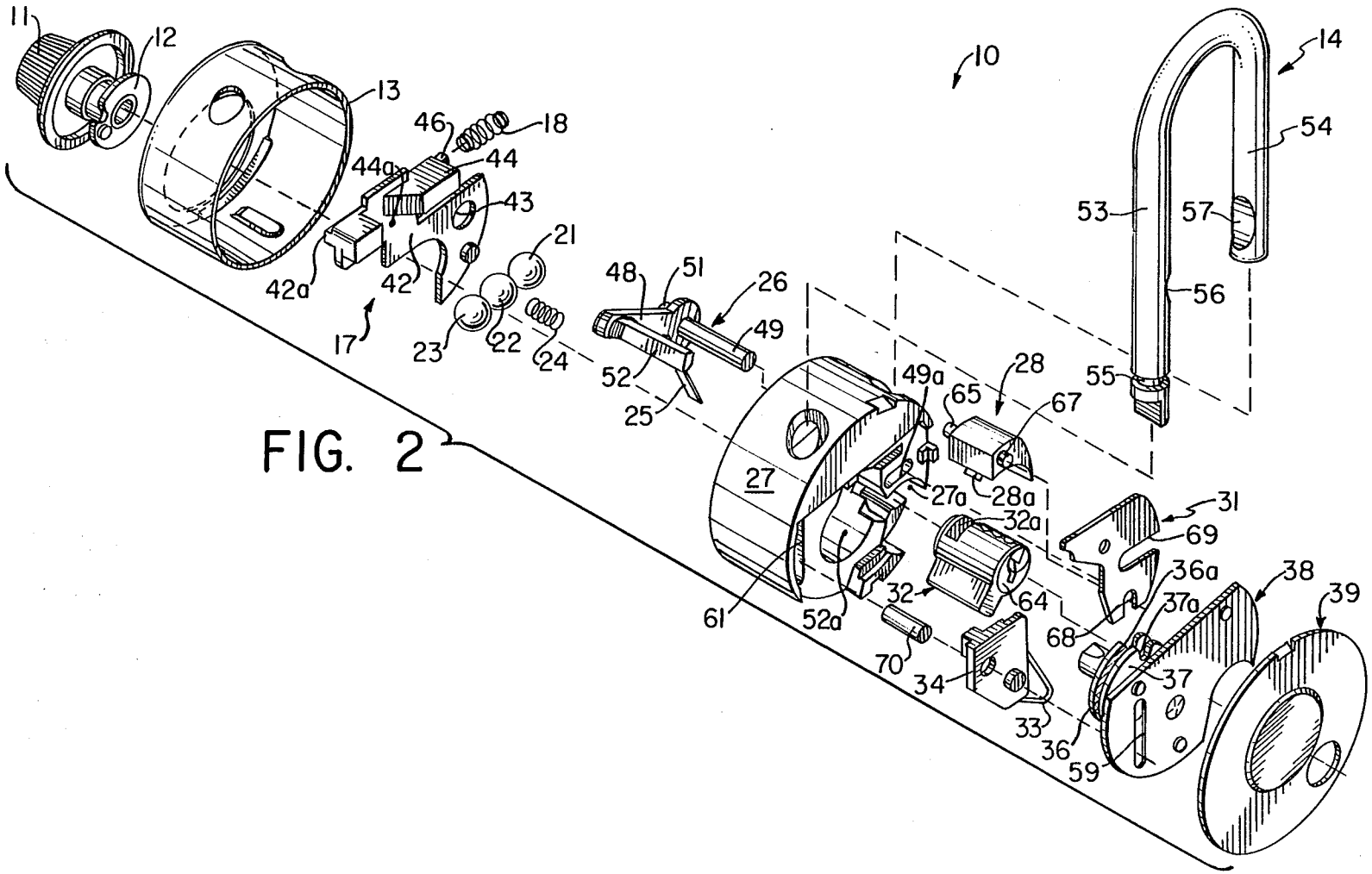
FIG. 2 is an exploded perspective view as seen from the back of the lock.
Figure 4:
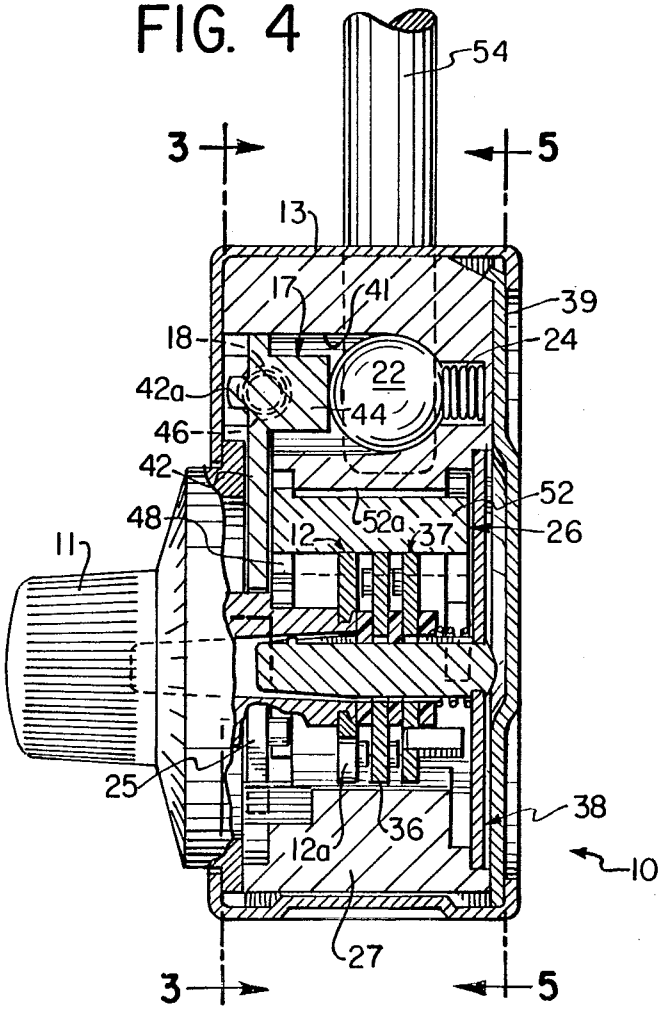
FIG. 4 is a sectional view taken along line 4—4 of FIG. 3.
Figure 3:
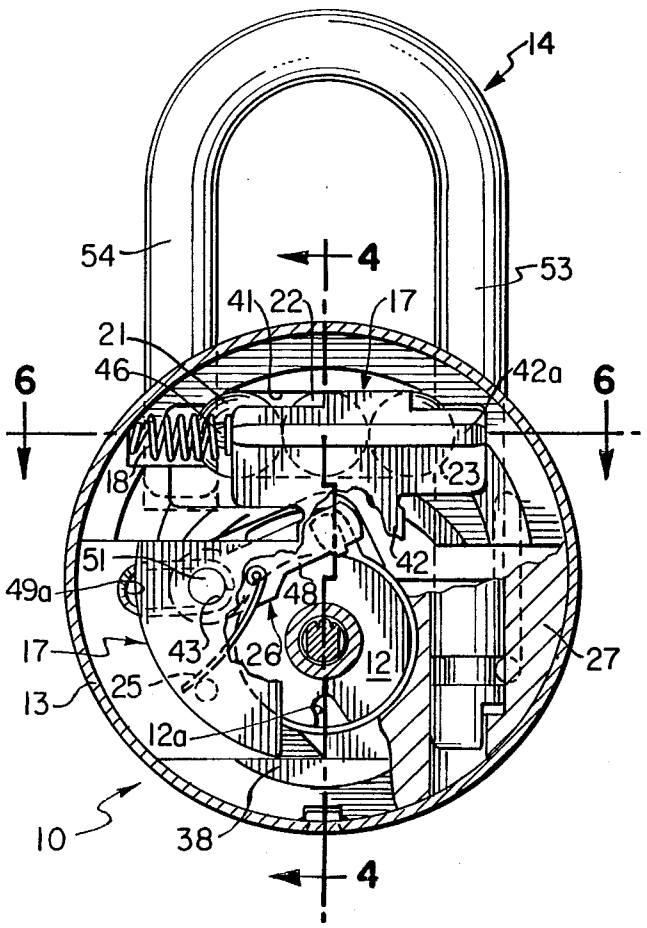
FIG. 3 is a sectional view taken along line 3—3 of FIG. 4.
Figure 6:
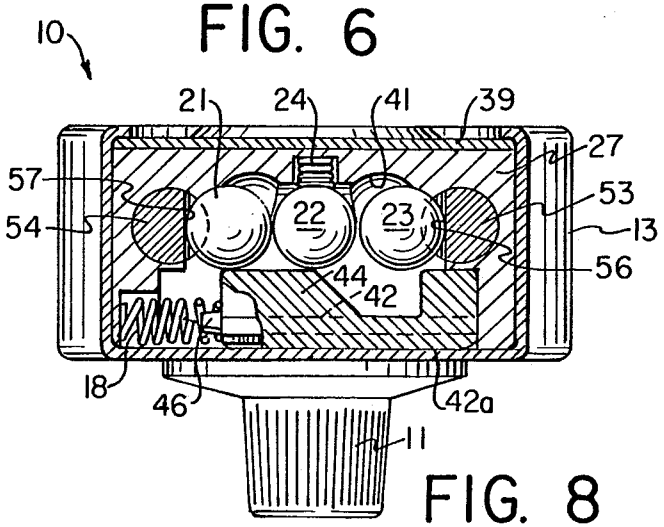
FIG. 6 is a sectional view taken along line 6—6 of FIG. 3.
Figure 8:
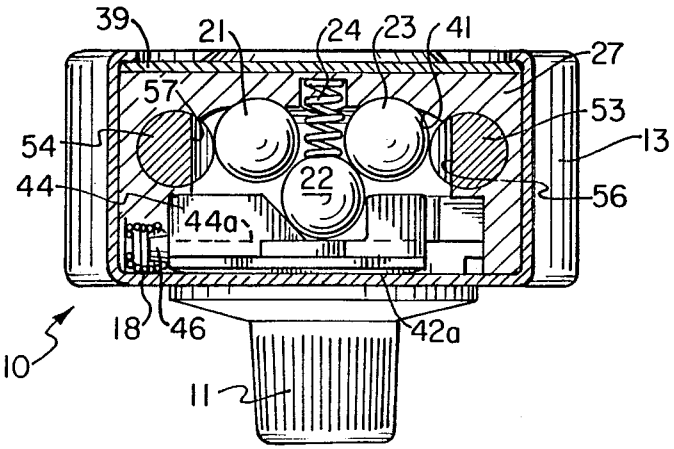
FIG. 8 is a sectional view taken along line 8—8 of FIG. 7.
Figure 5:
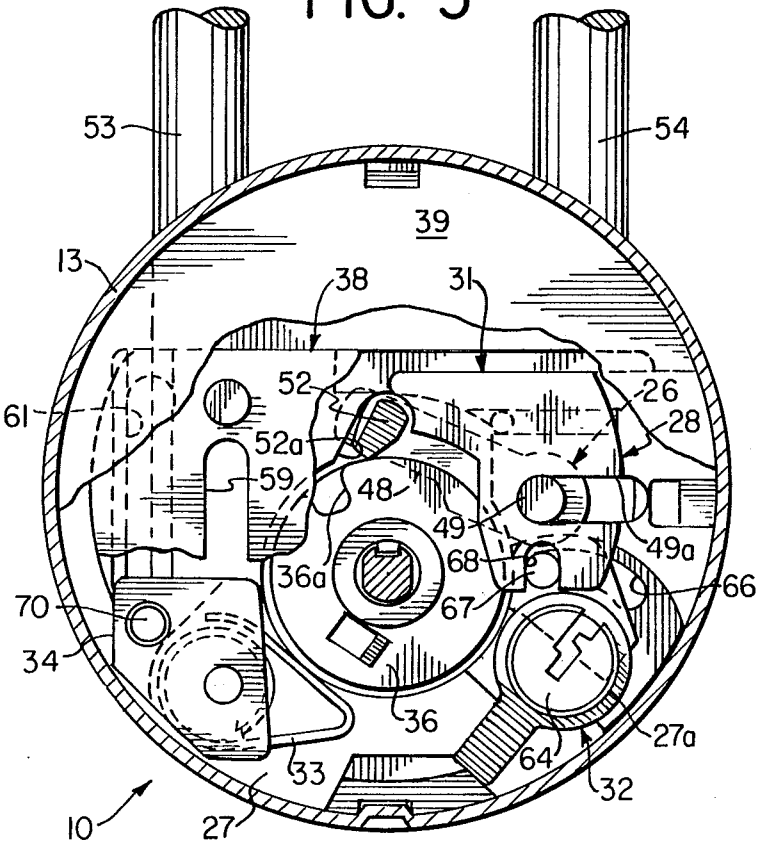
FIG. 5 is a sectional view taken along line 5—5 of FIG. 4.
Figure 7:
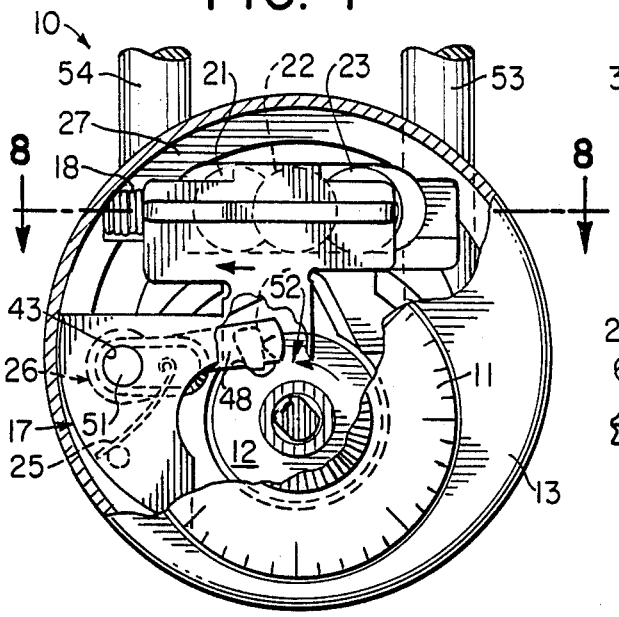
FIG. 7 is similar to the sectional view of FIG. 3 in which the lock is shown in its unlocked condition.

Referring to FIGS. 1 and 2, lock 10 includes a dial knob 11 carrying front combination disc 12, a main body housing 13, a shackle 14, a steel ball cam member 17, a cam member return spring 18, three (3) steel balls 21, 22, 23, a center ball spring 24, a drive lever 26, a main lock body 27, a key cylinder follower 28, a key control plate 31, a key lock body 32, an upset spring 33, an upset spring mount plate 34, middle combination disc 36, rearward combination disc 37, disc support plate 38, and housing ring 39.

Turning more broadly to FIGS. 1–8, main lock body 27 includes a steel ball chamber 41 in which steel balls 21, 22 and 23 together with control cam member 17, are housed and controlled. Chamber 41 is sized and shaped to permit cam member 17 to reciprocate partially therein, with spring 18 urging cam member 17 normally to the right as viewed in FIGS. 1 and 6. Cam member 17 can be moved to the left against spring 18 by counterclockwise movement of dial knob 11 provided the drive lever 26 has been engaged with discs 12, 36 and 37 as explained hereinafter. Cam member 17 includes vertical plate 42, plate ridge **42*a*, plate hole 43, ball cam piece 44 and spring mount extension 46**.

Driver lever 26 includes lever body piece 48, tubular extension 49, cam member boss 51 and bar extension 52. Tubular extension 49 ridges in lock body slot **49*a* while bar extension 52 rides in lock body opening 52*a***.

Driver lever 26 is rotatable about tubular extension boss 51 which bears in plate hole 43 and therefore driver lever 26 translates back and form together with the side-to-side movement of cam member 17. Driver lever 26 is biased by spring 25 urging extension 52 downwardly against discs 12, 36 and 37. Shackle 14 includes long shackle leg 53 and short shackle leg 54. Shackle leg 53 is held locked by ball 23 in leg notch 56 and leg 54 is held locked by ball 21 in notch 57 (see FIG. 6).

Operation of the lock to free shackle 53, 54 from balls 21 and 23 requires translating cam member 17 to the left (FIGS. 1 and 6) to permit center ball 22 to be urged by its spring 24 into cam piece opening **44*a*. As ball 22 moves into opening 44*a*, outer balls 21 and 23 move out of notches 56, 57 as upward movement of the shackle legs 53 and 54** begins to permit full release of the shackle legs.

Cam member 17 can be moved to the left (FIGS. 1 and 6) only by movement of driver lever 26 which in turn can be moved to the left (1) upon entry of bar extension 52 in grooves **12*a*, 36*a* and 37*a* of discs 12, 36 and 37 and subsequent turning of dial knob 11, or (2) by operation of the key system as described below. When the combination is dialed, disc grooves 12*a*, 36*a* and 37*a* are aligned to receive bar extension 52, rotation of dial knob 11 counterclockwise causes driver lever 26 to move to the left carrying with it cam member 17. The shackle legs 53, 54 become freed and the lock can be opened by pulling out the legs 53, 54**.

Figure 10:
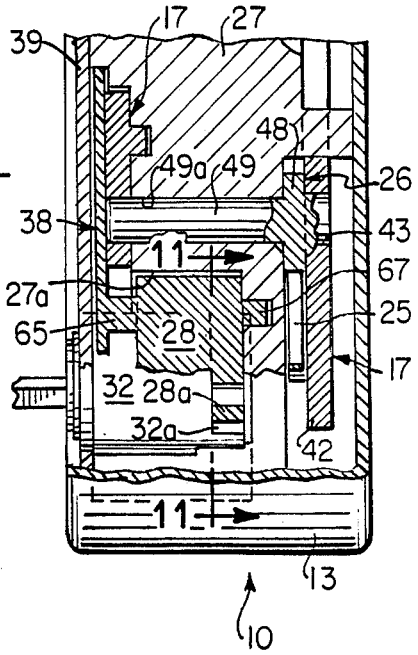
FIG. 10 is a sectional view taken along line 10—10 of FIG. 9.
Figure 9:
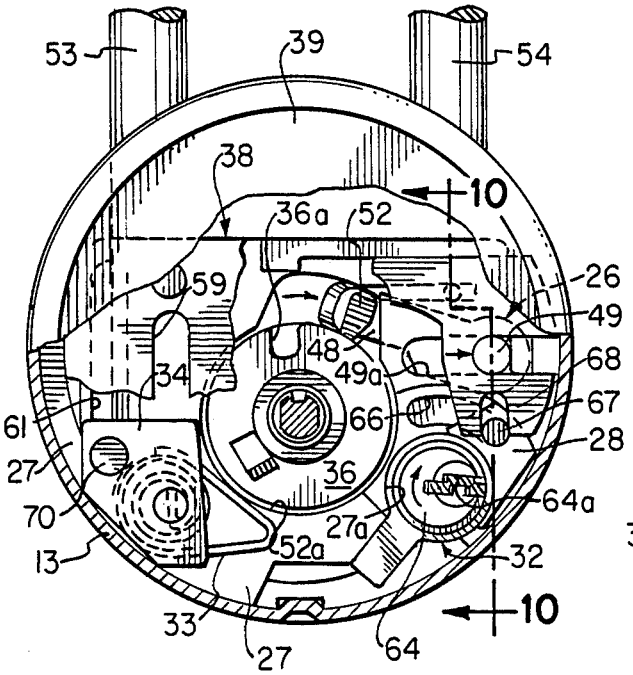
FIG. 9 is an elevational view partially broken away to show the key lock operation.
Figure 11:
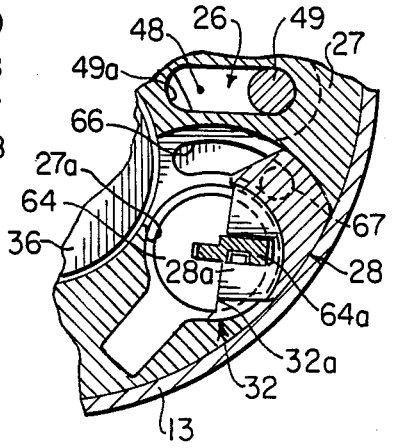
FIG. 11 is a sectional view taken along line 11—11 of FIG. 10.

Turning now to FIGS. 9–11 and the operation of key lock arrangement, key lock body 32 which fits in body cavity **27*a* of lock body 27 (see FIG. 2) has a key-operated cylinder 64 in its interior and a slot 32*a* (FIG. 2) which permits key cam projection 28*a* to engage the cylinder 64. When the key 64*a* (FIG. 10) turns cylinder 64 clockwise as viewed in FIG. 9, key cylinder follower 28 is moved to the right (all as viewed in FIGS. 2, 5 and 9). Rear key follower boss 67 engages in vertical slot 68 of plate 31 to cause plate 31 together with front key follower boss 65, riding in lock body archway groove 66 to move to the right (see FIGS. 5 and 9). As plate 31 moves rightward it carries tubular extension 49 captured in slot 69 of plate 31. Movement of tubular extension 49 in turn translates cam member 17** to open the lock position.

Figure 12:
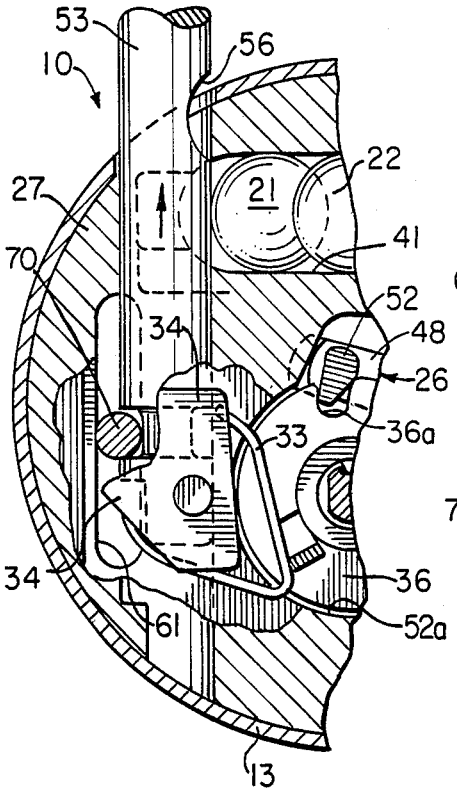
FIG. 12 is a partial elevational view showing the upset mechanism clearing a disc in upward shackle movement.
Figure 13:
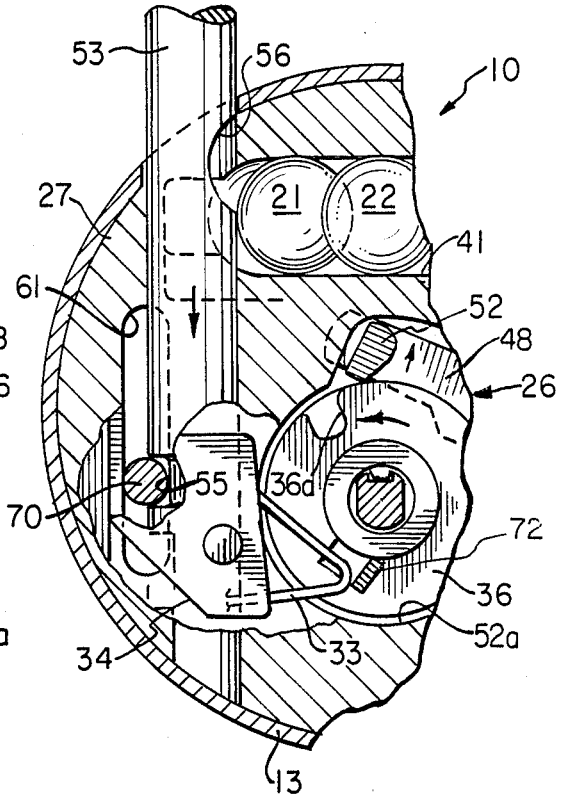
FIG. 13 is a view similar to FIG. 12 showing the upset mechanism operation in downward shackle movement.

Turning finally to FIGS. 12 and 13, during the upward movement of long shackle leg 53, upset spring plate 34 is moved upwardly due to its engagement with pin 70 positioned in notch 55 on leg 53 and bearing in housing groove 61. Plate 34 is guided by pin 58 riding in groove 59 of disc plate 38 (see FIG. 2). Spring 33 which is mounted on plate 34, deflects to pass detent 72 of rearward disc 37 (see FIG. 12). When shackle 53 is pushed downwardly to the lock position, ball 23 moves into shackle notch 56 releasing cam member 17 to move to its lock position. As cam member 17 moves its bar extension 52 ridges out of disc notches (including notch 37*a*; see FIG. 13). As shackle leg 53 nears its locking position, extension 52 leaves notch 37*a* and spring 33 engages detent 72 commencing its upset rotation of disc 37 (see FIG. 13). Shackle leg 53 continues its further movement downwardly with pin 70 bottom out in housing groove 61 and as spring 33 disengages from detent 72 rotation of disc 37 is completed.

I claim:

1. A combination lock including a dial and locking mechanism and a shackle having a long and short leg, the improvement comprising (a) a lock body;

(b) a lock body cavity with three (3) steel balls therein which balls include end balls and a center ball in general alignment in a first lock position;

(c) a notch in each shackle leg and a steel ball positional in each notch;

(d) a reciprocal cam plate means movable in the body cavity in a direction substantially perpendicular to the axes of the shackle legs to a first lock position to cause the steel end balls to be positioned in the leg notches, and slidable to a second unlock position to permit the center ball to move and with movement of the shackle to cause the steel end balls to exit the leg notches;

(e) an extending arm means mounted on the cam plate means engageable with the dial in the unlocked position so that rotation of the dial with the arm means so engaged causes the cam plate means to reciprocate; and (f) lock open cam means associated with the cam plate means so that partial removal of a shackle locks the cam plate means in the open position.

2. A combination lock including a dial and locking mechanism and a shackle having a long and short leg, the improvement comprising (a) a lock body;

(b) a lock body cavity with three (3) steel balls therein which balls include end balls and a center ball in general alignment in a first lock position;

(c) a notch in each shackle leg and a steel ball positional in each notch;

(d) a reciprocal cam plate means movable in the body cavity to a first lock position to cause the steel end balls to be positioned in the leg notches, and slidable to a second unlock position to permit the center ball to move out of said alignment and with movement of the shackle to cause the steel end balls of exit the leg notches;

(e) lever body means mounted on the cam plate means including a first extending arm means engageable with the dial in the unlocked position so that rotation of the dial with the first arm so engaged causes the cam plate means to reciprocate;

(f) lock open cam means associated with the cam plate means so that partial removal of a shackle locks the cam plate means in the open position;

(g) keg control means (i) engageable with a second extending arm mounted on the cam plate means and (ii) blocking movement of said first extending arm also mounted on said lever body means to prevent in turn movement of the cam plate means by application of external forces; and (h) key cam means pivotally connected to the key slide means and connected to the key cylinder to allow movement of the key slide means only when the key cylinder is operated;

whereby the rotation of the key cylinder or rotation of the dial causes the cam plate means to reciprocate to lock or free the shackle.

3. The combination lock of claim 2 in which the second extending arm includes a tubular arm means rotatably engageable with the cam plate means.

4. In a combination lock including a lock body, a dial assembly including combination discs, a shackle having two legs movable out of the lock to an open position and into the lock to a lock position, the improvement comprising (a) a lock body;

(b) a lock body cavity with a plurality of steel balls therein;

(c) a notch in a shackle leg and a steel ball positional in the notch;

(d) a reciprocal cam plate means movable in the body cavity in a direction substantially perpendicular to the axes of the shackle legs to a first position to cause the steel ball to be positioned in the leg notch, and slidable to a second position to permit the movement of the shackle to cause the steel ball to exit the leg notch;

(e) pivotal arm means mounted on the cam plate means including an arm engageable with the dial in the unlocked position so that rotation of the dial with the arm so engaged causes the cam plate means to reciprocate;

(f) lock open cams means associated with the cam plate means so that partial removal of a shackle locks the cam plate means in the open position;

(g) projection means on a combination disc;

(h) flexible spring means on a shackle leg position to engage such projections means as such leg is moved into and out of the lock body whereby the spring means flexes to pass the projection means as the leg is moved past the locked disc and whereby the spring means engages and rotates the projection means and its combination disc to upset the combination disc arrangement as and after the disc is unlocked and rotatable.

5. The combination lock of claim 4 in which the spring means includes a plate and a torsion spring mounted on the plate.

* * * * *